US006446424B2

(12) United States Patent
Thierron

(10) Patent No.: US 6,446,424 B2
(45) Date of Patent: Sep. 10, 2002

(54) PROCESS AND APPARATUS FOR THE PROPAGATION OF ROTATION AT THE TIE-IN POINT OF AN OPEN-END SPINNING APPARATUS

(75) Inventor: Wolfgang Thierron, Aachen (DE)

(73) Assignee: Rieter Ingolstadt Spinnereimaschinenbau, AG, Ingolstadt (DE)

( * ) Notice: Subject to any disclaimer, the term of this patent is extended or adjusted under 35 U.S.C. 154(b) by 0 days.

(21) Appl. No.: 09/728,593

(22) Filed: Dec. 1, 2000

(51) Int. Cl.[7] ..... D01H 4/00
(52) U.S. Cl. ..... 57/417
(58) Field of Search ..... 57/400, 401, 402, 57/403, 404, 405, 406, 407, 408, 409, 410, 411, 412, 413, 414, 415, 416, 417

(56) References Cited

U.S. PATENT DOCUMENTS

| | | | |
|---|---|---|---|
| 3,861,131 A | | 1/1975 | Le Chatelier |
| 4,011,712 A | | 3/1977 | Egbers et al. |

FOREIGN PATENT DOCUMENTS

| | | | |
|---|---|---|---|
| CZ | 161421 | | 11/1975 |
| DE | 3410246 A1 | * | 9/1985 |
| DE | 3410246 | | 9/1985 |
| DE | 4205485 | | 8/1993 |
| GB | 1155150 | * | 6/1969 |

OTHER PUBLICATIONS

German Patent Office Search Report Dated Mar. 13, 2000.

* cited by examiner

*Primary Examiner*—Danny Worrell
*Assistant Examiner*—Shaun R Hurley
(74) *Attorney, Agent, or Firm*—Dority & Manning, P.A.

(57) ABSTRACT

An Apparatus is described for the propagation of the rotary twisting of an open-end yarn from a yarn section in a thread guide to the entwinement point of an open-end spinning apparatus with a spinning element. A provision is made in the longitudinal extent of the thread guide for a thread contact surface, to which surface a vibration element is supplied. The thread contact surface possesses a polished surface and is part of an inlet element on the thread inlet end of the thread guide. The vibration element is connected to a control system, with the aid of which the frequency and/or the amplitude of the vibration generated by the vibration element can be made to match the current operational phase.

30 Claims, 1 Drawing Sheet

PROCESS AND APPARATUS FOR THE PROPAGATION OF ROTATION AT THE TIE-IN POINT OF AN OPEN-END SPINNING APPARATUS

BACKGROUND OF THE INVENTION

The present invention concerns an apparatus for the propagation of the rotary twisting of a yarn in a thread guide to the entwinement point in a open-end spinning machine having an open-end spinning element and concerns also a process which can be carried out with the aid of an apparatus of this type.

It is a matter of great importance in an open-end spinning machine, that at the point of yarn entwinement in which, during the yarn formation process, running fibers are forming into an open yarn-end, that sufficient rotation is provided to avoid a break in the newly incorporated yarn. To accomplish this, it is a conventional practice to interpose a device into an open-end spinning element in which the yarn is being made. This device, because of its structure and profiling, causes a periodic lifting of a yarn as it is being led through a thread guide at a change-of-direction surface of a thread intake element called a thread withdrawal nozzle. This lifting is done to enable the rotational twisting to propagate itself back to the entwinement point. Due to this profiling, however, the uniform twisting of the yarn seized in the withdrawal nozzle at the entrance to the thread guide, or within the thread guide, is detrimentally affected by temporary restraint and subsequent release of the yarn with the result that the surface of the produced yarn is roughened. In order to hold this undesirable side effect to a minimum an additional dummy rotator is provided in the thread guide, in order to increase the twist, so that, upon the true twist, a false twist is superimposed. On the grounds of the increased twist within the thread guide, the change-of-direction surface is to be more easily overcome. Further, the twist which builds itself up from the true twist and the false twist can propagate itself better back to the fiber entwinement point.

OBJECTS AND SUMMARY OF THE INVENTION

The principal object of the present invention is first, to create a possibility of achieving a good rotational propagation within the open-end spinning element, and second, to provide protective treatment of the yarn. Additional objects and advantages of the invention will be set forth in part in the following description or may be obvious from the description, or may be learned through practice of the invention.

This object is achieved by providing, in the longitudinal extent of the thread guide, a thread contact surface, in which a vibration element is installed. Since the yarn, upon its withdrawal in the course of its rotation in the thread guide, is not held back by a mechanical restraining element, the yarn is subjected to no high mechanical stress and its surface is not damaged. Further, because of the oscillation imparted to the yarn from the vibration element, the yarn is periodically lifted from the thread contact surface, so that the rotation during this phase can propagate effectively without hindrance in the direction toward the fiber entwinement point.

The thread contact surface can be an element independent of the thread guide, however, it may be advantageous, if this thread contact surface is part of the thread guide and the surface is an integral part of the thread guidance system.

Since it is particularly important that the twisting, which forms in the thread guide, propagates to the fiber entwinement point in order to encourage the fiber incorporation into the yarn end, provisions in an advantageous embodiment have been made so that the thread contact surface, which has been set into vibration, is positioned in the nearest possible location to the spinning element. To properly position the thread contact surface in such a manner, the thread contact surface may be a part of an inlet element on the thread inlet end of the thread guide.

An optimal release of the yarn can be achieved by having the inlet element stimulated by the vibration element in an axial direction.

It is true, that for the acquiring of special surface characteristics in the formed yarn, now as before, it is possible to install a thread contact surface with a profiled face. Yet, for the object of the invention, which is the propagation of the rotational twisting, such a designed surface is not required and as a rule, a smooth outer surface design which possesses a polished surface is preferred.

Principally, any optional vibration drive for producing the oscillations can be applied, but an electromagnetic drive has shown itself to be particularly advantageous.

For the achievement of an optimal result, in regard to the character of the yarn as it is made, an advantageous improvement of the invented apparatus allows various degrees of oscillations to be selected by connecting a control system to the vibration element for the control of frequency and/or amplitude. In connection with the control system, it is favorable for the simplification of the apparatus, if the control system is furnished with a multiplicity of vibration elements.

With the aid of the apparatus in accord with the invention, it becomes possible, not only to impart vibration to the yarn, and thereby to improve the propagation of twisting, but moreover, this control system can be made to coincide with the current operational phase. Thus, it is not a requirement during the start-up of spinning and during normal production to have always the same vibration brought to bear. During the start-up phase, a defined vibration, perhaps with a lower frequency and a reinforced amplitude, can be brought into action on the yarn. In this way, the twisting engendered in the thread guide can be transmitted in good order to the entwinement point. Subsequently, during the normal, undisturbed production, another vibration characteristic is applied, since the vibration in regard to frequency and amplitude is made to suit the altered spinning conditions, for example by increasing the frequency and amplitude. In a similar way, the oscillation characteristic of the speed of rotation of the spinning element, i.e., of the rotating force therein, can be matched and/or made to suit the fiber material to be spun.

In the concept of the present invention, the idea of "Rate of rotation of the spinning element" does not encompass only the RPM of a mechanical spinning element, but should, in many cases, also include the rotation speed of a pneumatic or electromagnetic vortex, which actually depends upon the individual design of the open-end spinning apparatus.

With the invention's aid, the twisting propagation to the entwinement point is improved, without a situation wherein the surface of the produced yarn must suffer, since the yarn, during its withdrawal in the longitudinal zone of the thread guide, generally passes therethrough over a predominately smooth surface. A false rotational element, on this account, can be dispensed with, insofar as the twist propagation to the entwinement point is concerned. Except in a protective treatment of the yarn captured in the withdrawal, the special advantage of the invented process and the invented apparatus, above all, can be seen in that the twist propagation to the entwinement point is carried out independently of the rotational speed of the open-end spinning element. Further, the characteristics of the vibration, regarding frequency and amplitude can be chosen freely in accord with the desired spinning conditions. As stated above, the choice is independent of the rotational speed of the spinning element, and is independent of the medium or magnetic forcefield which rotates therein. In this way, the process and the apparatus of the present invention make possible the matching of the twisting propagation to the current operation phase, to the spinning fiber material and the ongoing operational speed. Thus, during the entire spinning procedure, in spite of different spinning conditions, optimal relationships are always available for the propagation of the rotational twist.

Embodiment examples of the invention are explained below with the aid of the drawings.

DETAILED DESCRIPTION

Reference will now be made in detail to the presently preferred embodiments of the invention, one or more examples of which are shown in the figures. Each example is provided to explain the invention, and not as a limitation of the invention. In fact, features illustrated or described as part of one embodiment can be used with another embodiment to yield still a further embodiment. It is intended that the present invention cover such modifications and variations.

The apparatus in accord with the invention is explained in the following in connection with an open-end spinning apparatus 1, which possesses a spinning element 10 with a high speed, rotating spin-rotor.

The invention is not limited to one rotating spinning apparatus, but can also be employed in connection with open-end spinning apparatuses, which operate by a different open-end spinning principle. Examples of this would be an electrostatic open-end spinning apparatus with a circulating magnetic force, a pneumatic open-end spinning apparatus with a rotating air vortex or also a friction based spinning apparatus with one or more friction spinning elements. In all these examples, the open-end spinning apparatus 1 is provided with a thread withdrawal conduit 2 which serves a yarn G during its exiting from, or out of, the spinning element 10. This thread withdrawal conduit is fastened to a holder, which, depending on the individual kind of the open-end spinning apparatus, can be of varied design. In the case of an open-end spinning apparatus built as a rotor spinning machine, this holder is formed by a rotor cover 3, which is described later.

Figure 1:
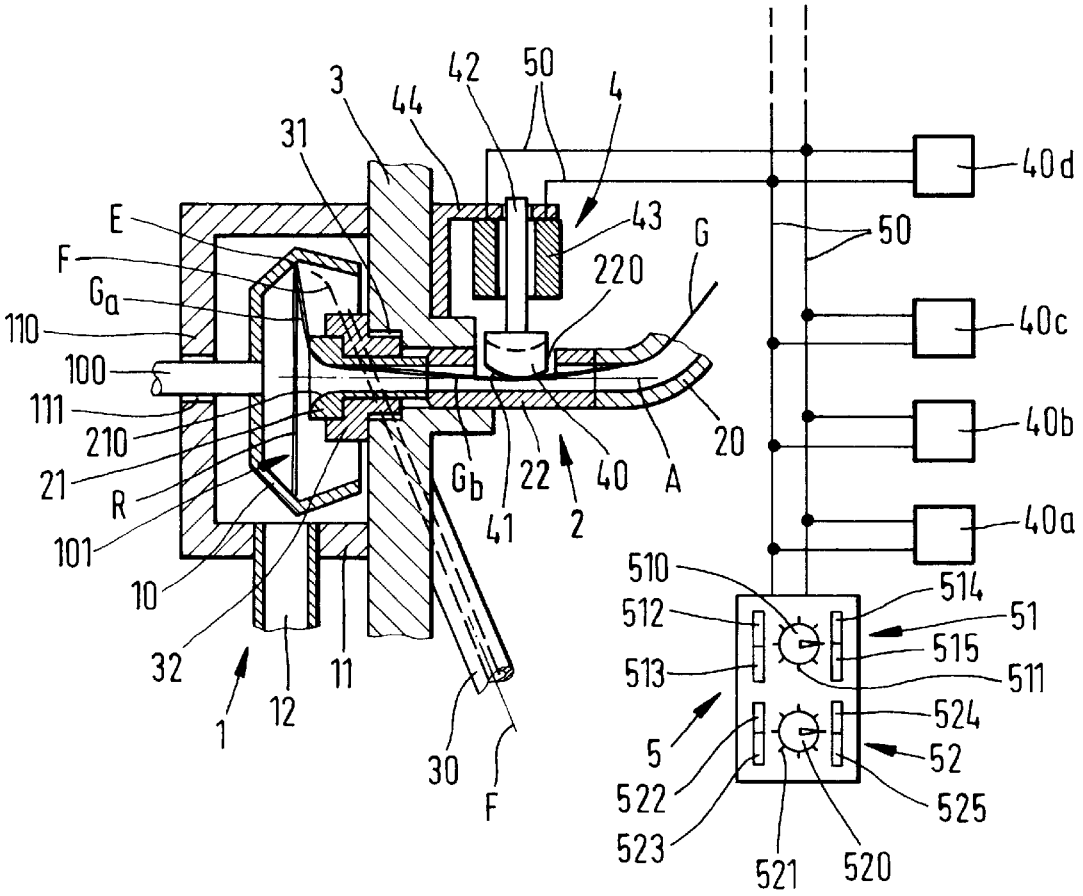
FIG. 1 shows a sectional view of an open-end spinning apparatus with a vibration device, in accord with the invention, and also presents a schematic drawing of the connections related to control.

FIG. 1 shows, besides the spin element 10, which is a spin rotor in the particular embodiment, principally those components of an open-end spinning apparatus 1 which are necessary for full comprehension of the invention. In the case of the rotor spinning apparatus, which has been chosen as an embodiment, the spin element 10, i.e., the spin rotor, is arranged in a pot-like rotor housing, which, with the aid of a suction connection 12, is in communication with a vacuum source (not shown), so that the suction necessary for spinning can be created in the spin rotor.

The spin rotor possesses a rotor shaft 100, which extends itself through a corresponding opening 111 in the base 110 of the rotor housing 11. With the aid of this shaft assembly, the spin rotor is supported in a conventional way and driven. Within that zone of the spin rotor with the greatest diameter, the spin rotor forms an annular fiber gathering surface 101.

The rotor housing 11, on its side remote from the base 110, is closed by the already mentioned rotor cover 3. This includes a fiber feed conduit 30, with which the spin rotor is supplied with fibers F which are to be spun. The yarn G, which has been conventionally spun, exits from the spin rotor through the mentioned thread guide 2.

The rotor cover 3 possesses on the side proximal to the spin rotor, a female socket 31 into which a receiving element 32 is threadedly secured. Into the receiving element 32, an exchangeable inlet element 21 is screwed. This inlet element 21, in the case of rotor spinning machines as a rule, is designated as a "thread withdrawal nozzle" and extends on into the rotor cover 3. In the axial connection to the inlet element 21, there is to be found a guide piece 22, which, in the case of the illustrated embodiment, is formed by a sheath like insert. On the side remote from the spin rotor, a thread withdrawal tube 20 connects to the mentioned guide piece 22. The withdrawal tube can be of optional shape and in a desired version (not shown) can be borne either by the guide piece 22 or by the rotor cover 3.

The inlet element 21, the guide piece 22 and the thread withdrawal tube 20 form together the mentioned thread guide 2 which, in relation to the movable rotor cover 3, is stationary.

The guide piece 22 possesses in its longitudinal extent a lateral recess 220 through which a vibration element 40 penetrates protruding into the interior of the guide piece 22. The vibration element 40 exhibits, in that area which protrudes into the interior of the guide piece 22, a smooth, thread contact surface 41. On its end remote from the guide piece 22, the vibration element 40 possesses a solenoid shaft 42, which is circumferentially enclosed by a coil 43. The solenoid shaft 42 in this manner is constructed as the armature of an electromagnet, which thus forms the drive 4 for the vibration element 40. The coil 43, with the aid of an angle iron 44 (or the like) is carried by the rotor cover 3. The coil 43 is connected by a line 50 with a control system 5.

The control system 5 can be made to serve only one open-end spinning apparatus. However, in accord with the example shown in FIG. 1, the control system is extended not only to the drive 4, that is, to the electromagnet, but also to vibration elements 40, 40*a*, 40*b*, 40*c*, 40*d* etc. These vibration elements, 40, 40*a*, 40*b*, 40*c*, 40*d* etc. are, for instance, located side by side in a common section of the open-end spinning machine.

During the spinning process, on a continuous basis, separate, individual fibers F are conducted through the inlet feed conduit 30 to the spinning element 10 which, in accord with the depicted embodiment in FIG. 1, is designed as a spin rotor. These fibers F deposit themselves in the spin rotor on the annular fiber gathering surface 101 thereof and are, in this place consolidated together, forming a fiber-ring R.

At an entwinement point E, the end of the yarn G stands in connection with the said fiber ring R.

The yarn G, which is formed, in a conventional way, by entwinement of the fibers F, is now, with the aid of means not shown, withdrawn in a continuous run from the spinning element 10 (spin rotor) and conducted further for windup on a spool (likewise not shown).

During the production of the yarn G, the spin rotor is driven in conventional fashion at a high speed, so that the end of the yarn G, which is in contact with the fiber ring R, rotates likewise at a high rotational speed. In this manner, the radial yarn section $G_3$, which extends from the entwinement point E to the inlet element 21 of the thread guide 2, acts as a crank arm and produces a true twisting rotation in the extending yarn section $G_b$ which extends itself along the thread guide 2.

In order to be able to integrate the fibers F at the entwinement point E into the end of the yarn G, which is in the course of formation, it is necessary that the rotation brought about in the yarn section $G_b$ inside the thread guide 2 be propagated back as far as the entwinement point. This propagation is made difficult, in that the yarn G must change direction over a turning surface 210 formed on the inner contour of the inlet element 21, and, by doing so, adhere in some measure thereto.

In order to reduce this adhesive force and thereby make the desired rotation possible over the turning surface 210 and thus extend the rotation all the way to the entwinement point E, the vibration element 40, with the aid of the coil 43 is set into oscillation. The yarn G, which is found in the withdrawal tube, lies within the thread guide 2 with its yarn section $G_b$ on the thread contact surface 41 of the vibration element 40, so that the oscillation from the vibration element 40 is transferred to the yarn G.

Because of this oscillation, the yarn G is tensioned and again relaxed in quickly repeated succession. During the relaxation phase, the twisting from the yarn section $G_b$ proceeds into the yarn section $G_a$ and thereby to the entwinement point E. Because of this rotation being propagated to the entwinement point E, the fiber ring R, by means of the end of the yarn section $G_a$ which is now rotating, binds itself into this end.

The apparatus described above in construction and function can, within the framework of the invention, be altered in numerous ways particularly by the exchange of single or several features or through other combination of features or their equivalents. Thus, for example, it is not required to lift the yarn G from the turning surface 210 by a vibration acting transverse to the longitudinal extent of the thread guide 2, thereby reducing the pressure of the yarn G against the turning surface 210, so that the rotation over the turning surface can extend itself to the entwinement point E. A corresponding embodiment of the previously mentioned apparatus is described in the following, based on the embodiment shown in FIG. 2, wherein the oscillation is produced in a direction parallel to the longitudinal axis A of the thread guide 2.

Figure 2:
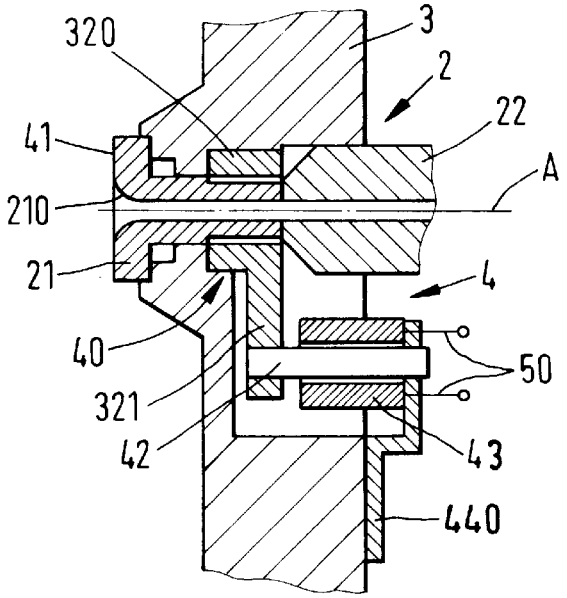
FIG. 2 shows a portion of an altered vibration device in accord with the invention.

In the case of the embodiment shown in FIG. 2, the yarn is not set into vibration at any point within the guide 2, but this is effected immediately at the entrance of the inlet element 21. To carry out this purpose, this inlet element 21 is screwed into a receiving element 320, which, of its own, can be brought into vibration and thus can serve as a vibration element 40. In doing this, the change of direction surface 210 functions simultaneously as the thread contact surface 41 of the vibration element 40. A drive 4 is connected to the receiving element 320, which is constructed as a movable part of the otherwise stationary thread guide 2 seated in rotor cover 3. This drive 4 in the embodiment shown in FIG. 2 is again designed as an electromagnet. For this purpose, the receiving element 320 possesses an arm 321 extending outward in a radial direction, with which the solenoid shaft 42, serving as armature of the electromagnet, is connected. The coil 43 circumferentially encloses the solenoid shaft 42 and is connected by electrical line 50 to the control system 5 (see FIG. 1). The coil 43 is carried by means of an angle iron 440 (or the like) extending from the rotor cover 3.

Where this above described construction of the thread guide 2 is concerned, the thread contact surface 41 is formed by a movable part of the thread guide 2, namely, by the inlet element 21. Even in the case of such a design of the apparatus, the rotation propagation is thereby improved, in that the yarn G, in the neighborhood of the entry end of the thread guide 2, which end is proximal to the spin rotor, is periodically lifted from the turning surface 210. In this manner, the twisting rotation is enabled to be propagated from its point of origin in the interior of the thread guide 2 back to the entwinement point E, and thereby a fault-free entwinement of the fiber ring R into the end of the yarn section $G_a$ is assured.

It is advantageous, but yet not necessarily required, that the inlet element 21—as has previously been described—be set into vibration in an axial direction. Alternatively, a provision can be made that the arm 321 continues on into the solenoid shaft 42, which is designed as an armature of an electromagnet. The shaft can protrude essentially perpendicularly to the longitudinal extension of the inlet element 21 and that of the thread guide 2. Even in the case of a design of this kind of the thread guide 2 and of the vibration element 40, a periodic release of the yarn G is attained, so that even here a good and assured propagation of the rotation in the direction of the entwinement point E is achieved. A beneficial provision would be that oscillatory motion can be induced both in an axial direction as well as transverse to the longitudinal extent of the inlet element 21.

In a particularly advantageous embodiment of the invention, provisions can be made to construct an armature shaft 42 operating in conjunction with a coil 43 within a combination inlet element 21 and thread withdrawal nozzle. In this way, by means of the coil in connection with the shaft 42, which enters the withdrawal nozzle, the assembly can be located and held in an open-end spin apparatus without any other holding means, such as retaining screws.

In accord with the previously known state of the technology, where rotational motion propagation to the entwinement point E was concerned, it was taken as a necessary evil that in the inlet element 21 or in the yarn withdrawal tube 20, or yet again at another place within the thread guide 2, the yarn G would be subjected to a severe mechanical loading in the described apparatus. It is not necessary to have the yarn G undergo such stress. It is entirely possible, and generally preferred, that the contact surfaces, which the yarn G touches within the thread guide 2, exhibit a smooth surface, even the thread contact surface 41 of the vibration element 40. Should, however, a definite contouring of one or more such surfaces be desired for other reasons, for instance, in order to lend the yarn G a bulgy appearance, then there is nothing in the present design which would prevent such adaption. Such surfaces can then, without consideration of the desirable propagation, be formulated solely on the basis of the desired character of the yarn in regard to the appearance thereof.

Principally, it is advantageous in the case of the described apparatus to have the yarn G simply passing over highly polished surfaces. Moreover, except in cases of protective treatment of the yarn G while in the withdrawal means, it is beneficial for the invented process and apparatus to assure that the rotational propagation to the entwinement point E is carried out independent of the rotational speed of the open-end spinning element and that the type of vibration in regard to frequency and amplitude can be freely selected. This will be described in the following.

In an open-end spinning apparatus 1, the start of the yarn is a sensitive procedure, independent as to whether it is a first time startup of the spinning operation after a long standstill, or whether the matter concerns startup after a yarn break. This procedure is done accordingly by the present day high rotational speeds of the spinning elements 10, that is, of a spin rotor, during the spin rotor's top RPM. When speed is reduced, the action on the yarn section $G_a$ is thus not so much due to high centrifugal force, as is the case during normal operation.

In order to assure acquiring a reliable entwining of the fiber ring R into the end of the yarn section $G_a$, provisions can be made that, during this time, the rotational propagation to the entwinement point E is optimized by correspondingly matching the generation of the vibration to meet the special demands in force during a current operational phase. This matching can be done, for instance, by an increase of the frequency and/or the amplitude. In a case wherein the amplitude has been increased, the rotational propagation under certain circumstances can also be improved in that the frequency is reduced relative to that of the normal spinning operation. By the change of one of these values, or both, optimal conditions, which have been empirically determined as best for each operational phase, can be produced.

A change of the frequency and/or the amplitude is beneficial not only because of the fit to a certain operational phase. By the working of different fiber materials, which accordingly require different spinning conditions and different rotational speeds of the open-end spinning apparatus, the current spinning conditions can be optimized by corresponding adjustments of the character of the vibration.

In the simplest design of the apparatus, the control system 5 provides only a single definite frequency and only one definite amplitude for the vibration element 40. An improved design of the control system 5 is shown in FIG. 1. The control system 5, shown there as one embodiment, possesses a first regulation device 51 which has an adjusting knob 510, a scale 511, as well as four display fields 512, 513, 514 and 515. The control system S exhibits further, in accord with the shown embodiment, a second regulation device 52 with an adjustment knob 520, a scale 521, as well as four display fields 522, 523, 524 and 525. The first regulation device 51 serves for the adjustment of the desired frequency, while the second regulation device 52 allows for the adjustment of the amplitude.

The adjustment knobs 510 and 520 are designed as being multifunctional in accord with the shown embodiment. Thus, by the activation of the adjustment knobs 510, 520, respectively, the value of the frequency or the amplitude can be set to the desired degree.

First, these values would be set for the initial operational phase, that is, spinning startup, which is respectively shown in the first display field 512, 522. By pressing the adjustment knob 510, 520, a switchover to the next operational phase is effected, that is, the normal run of the spinning process. This is shown in the second display field 513, 523. Also, respectively, the desired value can be obtained by the turning of the knob 510, 520. Further adjustment possibilities are possible by switching onto the further display fields, respectively 514, 515 and 524, 525.

Other designs of the respective regulation device 51, 52 are obviously possible. Also, further presetting possibilities can be provided by corresponding extension of developments in the control system 5.

It is plain to see, that principally the vibration to the yarn section $G_b$ can be transmitted at any optional location within the thread guide 2. Experience has shown, however, that it is advantageous if this is done in the nearest possible location to the entry end of the thread guide 2, i.e, as close as possible to the area of the inlet element 21. The true yarn rotation induced by the yarn section $G_a$ functioning as a crank forms itself in the subsequent longitudinal zone of the thread guide 2 which adjoins the change of direction, or turning surface 210. In this way, the contact of the yarn section $G_b$ on the thread contact surface 41 of the vibration element 40 so acts, that the propagation of the twisting in the direction to the thread withdrawal tube 20 is retarded. In this way, the rotational twisting, which propagates itself in the direction of the entwinement point E, can be proportionally intensive, the smaller the distance is chosen between the turning surface 210 and the thread contact surface 41.

As the present explanation indicates, the rotational twist is thereby propagated to the entwinement point E in such a manner, that the yarn G is brought into oscillation and thereby periodically lifts itself from the turning surface 210.

The special mode of the design of the drive 4 for the generation of vibration and the distribution of the same is of no relevant importance. Those designs thereof in the illustrations are thus simply embodiment examples.

Instead of the shown construction of the drive 4, it is also possible to produce the vibrations by purely mechanical means. For instance, cams can be provided on a shaft, which direct, or with an interposed vibration element, (similar to the shown vibration element 40) can cause the desired effect in the yarn G. By means of an exchange of the cam for a cam of another size or shape, the shape of the vibration and/or amplitude can be changed, while the vibration frequency can be controlled by the RPM determined for the cams. It is also possible at a specified distance from the turning surface 210 in the area of the guide piece 22 to place a membrane or another appropriate intervening element, for instance, wherein a tube or a bellow forms a part of the thread guide 2 in a portion of its longitudinal section, which makes the movable part thereof This can be, for example, a pulsating pneumatic medium for the generation of the oscillations.

It will be appreciated by those skilled in the art that various modifications and variations can be made in the present invention without departing from the scope of the invention. It is intended that the present invention include such modifications and variations as come within the scope of the appended claims and their equivalents.

What is claimed is:

1. An open-end spinning apparatus that insures propagation of the rotary twisting of an open-end yarn from the point of withdrawal of said yarn from said open-end spinning apparatus to the entwinement point of fiber into said yarn, said apparatus comprising:

a spinning element which converts said fiber into said open -end yarn;

a fiber feed conduit which feeds said fiber to said spinning element for processing said fiber into said yarn;

a thread guide proximal to said spinning element, which retrieves said yarn from said spinning element and guides said open-end yarn as it is withdrawn from said open-end spinning apparatus;

a thread contact surface movably configured within said thread guide, said thread contact surface comes into contact with said open-end yarn as said yarn is withdrawn from said spinning apparatus; and a vibration element operably disposed to said thread contact surface, said vibration element causing said thread contact surface to vibrate said open-end yarn allowing propagation of the rotary twist of said yarn from within said thread guide to said entwinement point.

2. An open-end spinning apparatus as in claim 1, wherein said vibration element and said thread contact surface are disposed proximal to an inlet of said thread guide, through which said open-end yarn enters as said yarn exits said spinning element.

3. An open-end spinning apparatus as in claim 2, wherein said thread guide includes an inlet element, which receives said open-end yarn as said yarn leaves said spinning element.

4. An open-end spinning apparatus as in claim 1, wherein said vibration element includes a drive system which creates the frequency and amplitude of the vibration that said vibration element imparts to said yarn.

5. An open-end spinning apparatus as in claim 4, wherein said drive system of said vibration element is an electromagnetic drive.

6. An open-end spinning apparatus as in claim 4, further comprising a control system connected to said vibration element in which said control system regulates the frequency and amplitude of said vibration imparted to said yarn.

7. An open-end spinning apparatus that insures propagation of the rotary twisting of an open-end yarn from the point of withdrawal of said yarn from said open-end spinning apparatus to the entwinement point of fiber into said yarn, said apparatus comprising:

a spinning element which converts said fiber into said open-end yarn;

a fiber feed conduit which feeds said fiber to said spinning element for processing said fiber into said yarn;

a thread guide proximal to said spinning element, which retrieves said yarn from said spinning element and guides said open-end yarn as it is withdrawn from said open-end spinning apparatus, said thread guide having an inlet element, which receives said open-end yarn as said yarn leaves said spinning element; and a vibration element operably configured with said inlet element, said vibration element stimulating said inlet element in an axial direction causing said open-end yarn to vibrate, propagating the rotary twist to the entwinement point as well as further up the section of said yarn within said thread guide.

8. An open-end spinning apparatus as in claim 7, wherein said vibration element includes a drive system which creates the frequency and amplitude of the vibration that said vibration element imparts to said yarn.

9. An open-end spinning apparatus as in claim 8, wherein said drive system of said vibration element is an electromagnetic drive.

10. An open-end spinning apparatus as in claim 8, further comprising a control system connected to said vibration element in which said control system regulates the frequency and amplitude of said vibration imparted to said yarn.

11. An open-end spinning apparatus that insures propagation of the rotary twisting of an open-end yarn from the point of withdrawal of said yarn from said open-end spinning apparatus to the entwinement point of fiber into said yarn, said apparatus comprising:

a spinning element which converts said fiber into said open-end yarn;

a fiber feed conduit which feeds said fiber to said spinning element for processing said fiber into said yarn;

a thread guide proximal to said spinning element, which retrieves said yarn from said spinning element and guides said open-end yarn as it is withdrawn from said open-end spinning apparatus;

a vibration element operably configured with said thread guide, said vibration element causing said open-end yarn to vibrate allowing propagation of the rotary twist of said yarn from within said thread guide to said entwinement point;

a drive system operably disposed to said vibration element, said drive system creating the frequency and amplitude of the vibration that said vibration element imparts to said yarn; and a control system connected to said drive system in which said control system regulates the frequency and amplitude of said vibration imparted to said yarn from said vibration element.

12. An open-end spinning apparatus as in claim 11, wherein said control system regulates a multiplicity of said vibration elements.

13. An open-end spinning apparatus as in claim 11, wherein said control system establishes a frequency and amplitude of said generated vibration that corresponds to the current operational phase of said open-end spinning apparatus to optimally obtain the desired twist within said open-end yarn.

14. An open-end spinning apparatus as in claim 11, w herein said vibration element is disposed proximal to an inlet of said thread guide, through which said open-end yarn enters as said yarn exits said spinning element.

15. An open-end spinning apparatus as in claim 14, wherein said thread guide includes an inlet element, which receives said open-end yarn as said yarn leaves said spinning element.

16. An open-end spinning apparatus as in claim 15, wherein said inlet element is stimulated in an axial direction by said vibration element causing said open-end yarn to vibrate, propagating the rotary twist to the entwinement point as well as further up the section of said yarn within said thread guide.

17. An open-end spinning apparatus as in claim 11, further comprising a thread contact surface integral to said vibration element, said thread contact surface comes into contact with said open-end yarn as said yarn is withdrawn from said spinning apparatus causing said thread contact surface to vibrate said yarn.

18. An open-end spinning apparatus as in claim 17, wherein said thread con tact surface is a movable component of the stationary thread guide.

19. An open-end spinning apparatus that insures propagation of the rotary twisting of an open-end yarn from the point of withdrawal of said yarn from said open-end spinning apparatus to the entwinement point of fiber into said yarn, said apparatus comprising:

a spinning element which converts said fiber into said open-end yarn;

a fiber feed conduit which feeds said fiber to said spinning element for processing said fiber into said yarn;

a thread guide proximal to said spinning element, which retrieves said yarn from said spinning element and guides said open-end yarn as it is withdrawn from said open-end spinning apparatus;

a vibration element operably configured with said thread guide, said vibration element causing said open-end yarn to vibrate allowing propagation of the rotary twist of said yarn from within said thread guide to said entwinement point; and a mechanical drive system operably disposed to said vibration element, said drive system creating the frequency and amplitude of the vibration that said vibration element imparts to said yarn.

20. A process for propagating the rotary twisting of an open-end yarn from the point of withdrawal of the yarn from an open-end spinning apparatus to the entwinement point of fibers into said yarn, said process comprising:

spinning fibers into yarn within an open-end spinning element disposed within the open-end spinning apparatus;

retrieving the yarn from the open-end spinning element through a thread guide proximal to the open-end spinning element; and vibrating the yarn via a vibration element operably disposed to a thread contact surface movably configured within the thread guide in such a manner that the vibration element vibrates the thread contact surface contacting the yarn which propagates the rotary twisting of the yarn from the thread guide to the entwinement point of the fibers into yarn.

21. A process as in claim 20, wherein the vibration created by the vibration element is generated in the yarn in close proximity to the inlet of the thread guide, through which the open-end yarn enters as the yarn exits the spinning element.

22. A process as in claim 20, wherein the vibration produced by the vibration element is created in such a manner that the rotary twisting of the yarn propagates in both directions of the yarn from the point of the vibrational generation.

23. A process as in claim 20, further comprising controlling the vibration within the yarn by regulating the frequency and amplitude of vibration created by the vibration element using a control system integrally connected to the vibration element.

24. A process for propagating the rotary twisting of an open-end yarn from the point of withdrawal of the yarn from an open-end spinning apparatus to the entwinement point of fibers into said yarn, said process comprising:

spinning fibers into yarn within an open-end spinning element disposed within the open-end spinning apparatus;

retrieving the yarn from the open-end spinning element through a thread guide proximal to the open-end spinning element;

vibrating the yarn via a vibration element in such a manner as to propagate the rotary twisting of the yarn from the thread guide to the entwinement point of the fibers into yarn; and controlling the vibration within the yarn by regulating the frequency and amplitude of vibration created by the vibration element using a control system integrally connected to the vibration element.

25. A process as in claim 24, further comprising regulating the vibration using the control system in such a manner that the frequency and amplitude of the vibration corresponds to the current operational phase of said open-end spinning apparatus to optimally obtain the desired twist within said open-end yarn.

26. A process as in claim 25, wherein the frequency and the amplitude selected by the control system takes into consideration the speed of rotation of the open-end spinning element and the type of fiber to be spun.

27. A process as in claim 26, wherein the frequency and the amplitude of the desired vibration is manually settable.

28. A process as in claim 24, wherein the vibration created by the vibration element is generated in the yarn in close proximity to the inlet of the thread guide, through which the open-end yarn enters as the yarn exits the spinning element.

29. A process as in claim 24, wherein the vibration produced by the vibration element is created in such a manner that the rotary twisting of the yarn propagates in both directions of the yarn from the point of the vibrational generation.

30. A process for propagating the rotary twisting of an open-end yarn from the point of withdrawal of the yarn from an open-end spinning apparatus to the entwinement point of fibers into said yarn, said process comprising:

spinning fibers into yarn within an open-end spinning element disposed within the open-end spinning apparatus;

retrieving the yarn from the open-end spinning element through a thread guide proximal to the open-end spinning element; and vibrating the yarn via a vibration element operably disposed to an inlet element movably configured to an inlet of the thread guide in such a manner that the vibration element vibrates the inlet element contacting the yarn as the yarn enters the inlet element which propagates the rotary twisting of the yarn from the thread guide to the entwinement point of the fibers into yarn.

* * * * *